US008820311B2

(12) United States Patent
Ryu et al.

(10) Patent No.: US 8,820,311 B2
(45) Date of Patent: Sep. 2, 2014

(54) OVEN RANGE

(75) Inventors: Jung Wan Ryu, Changwon (KR); Dae Bong Yang, Changwon (KR); Jea Hyuk Wie, Changwon (KR); Yong Ki Jeong, Changwon (KR); Jae Bum Lim, Changwon (KR); Young Soo Kim, Changwon (KR); Yang Ho Kim, Changwon (KR); Dae Rae Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 367 days.

(21) Appl. No.: 12/994,822

(22) PCT Filed: May 27, 2009

(86) PCT No.: PCT/KR2009/002816

§ 371 (c)(1), (2), (4) Date: Feb. 22, 2011

(87) PCT Pub. No.: WO2009/145567

PCT Pub. Date: Dec. 3, 2009

(65) Prior Publication Data

US 2011/0132350 A1 Jun. 9, 2011

(30) Foreign Application Priority Data

May 28, 2008 (KR) ..... 10-2008-0049582

(51) Int. Cl.

| | |
|---|---|
| ***F24C 3/00*** | (2006.01) |
| ***F24C 3/08*** | (2006.01) |
| ***F24C 15/32*** | (2006.01) |

(52) U.S. Cl.

CPC ..... *F24C 15/322* (2013.01); *F24C 3/087* (2013.01)

USPC ..... 126/39 E; 126/21 A; 126/21 R; 126/25 R; 126/340

(58) Field of Classification Search

USPC ..... 126/39 E, 21 A, 21 R, 25 R, 340

See application file for complete search history.

(56) References Cited

U.S. PATENT DOCUMENTS

| | | | | | |
|---|---|---|---|---|---|
| 3,658,050 | A | * | 4/1972 | Snyder | 126/340 |
| 3,783,854 | A | * | 1/1974 | Hurko et al. | 126/21 R |
| 3,851,639 | A | * | 12/1974 | Beddoe | 126/25 R |
| 4,368,722 | A | * | 1/1983 | Lynch | 126/77 |
| 5,460,157 | A | * | 10/1995 | Prabhu | 126/21 A |
| 5,655,511 | A | * | 8/1997 | Prabhu et al. | 126/21 A |
| 7,847,219 | B2 | * | 12/2010 | Kim et al. | 219/391 |
| 2007/0158340 | A1 | | 7/2007 | Kim et al. | |

FOREIGN PATENT DOCUMENTS

| | | | |
|---|---|---|---|
| KR | 0132124 | B1 | 4/1998 |
| KR | 20-0203986 | Y1 | 11/2000 |
| KR | 10-0562109 | B1 | 3/2006 |
| KR | 10-0767850 | B1 | 10/2007 |

* cited by examiner

*Primary Examiner* — Kenneth Rinehart
*Assistant Examiner* — Gajanan M Prabhu
(74) *Attorney, Agent, or Firm* — Birch, Stewart, Kolasch & Birch, LLP

(57) ABSTRACT

Provided is an oven range. A communication opening which is formed at a front end of a bottom surface of an oven chamber is selectively opened or closed by an opening/closing member linked to the rotation of an oven door for opening or closing the oven chamber. Accordingly, the oven range is advantageous as it uniformly cooks a food and simultaneously prevents a burner from being contaminated.

10 Claims, 3 Drawing Sheets

OVEN RANGE

BACKGROUND

The present disclosure relates to a cooker, and more particularly, to an oven range in which foods are cooked using a burner.

Oven ranges are cookers in which foods are cooked using flame or hot air, which is generated in a burner operated by gas or electricity. Typically, such an oven range includes an oven chamber for receiving foods. The oven chamber is selectively opened or closed by an oven door. Also, the oven range includes an upper burner, a lower burner, and a convention fan as a heating source for cooking foods.

However, an oven range according to a related art has following limitations.

Typically, the lower burner is installed at lower side of the oven chamber to heat air, thereby generating hot air. When the convection fan is operated, the hot air generated by the lower burner heats a food while it is circulated within the oven chamber. Thus, an opening for transmitting the hot air generated in the lower burner into the oven chamber is defined in a bottom surface of the oven chamber. However, since the food is seated on the bottom surface, the opening for transmitting the hot air is not defined in a front end of the bottom surface in consideration of the taste and contamination of the lower burner due to foreign substances such as food waste. Thus, there is a limitation that the food received in the oven chamber is not uniformly heated.

SUMMARY

Embodiments provide an oven range configured to more efficiently cook a food.

Embodiments also provide an oven range configured to minimize contamination of a burner due to foreign substances.

In one embodiment, an oven range includes: a cooking chamber in which a food is cooked; a heating chamber in which a heating source for cooking the food within the cooking chamber is disposed; at least one communication opening allowing the cooking chamber to communicate with the heating chamber; and an opening/closing device selectively opening or closing the communication opening.

In another embodiment, an oven range includes: an oven cavity having an oven chamber in which a food is cooked and a burner chamber in which a burner is disposed; a bottom plate partitioning the oven chamber and the burner chamber, the bottom plate having at least one communication opening for transmitting hot air of the burner into the oven chamber; an oven door selectively opening or closing the oven chamber; and an opening/closing device selectively opening or closing the communication opening according to opening or closing of the oven chamber by the oven door.

The details of one or more embodiments are set forth in the accompanying drawings and the description below. Other features will be apparent from the description and drawings, and from the claims.

DETAILED DESCRIPTION OF THE EMBODIMENTS

Hereinafter, an oven range according to an embodiment will be described in detail with reference to the accompanying drawings.

Figure 1:
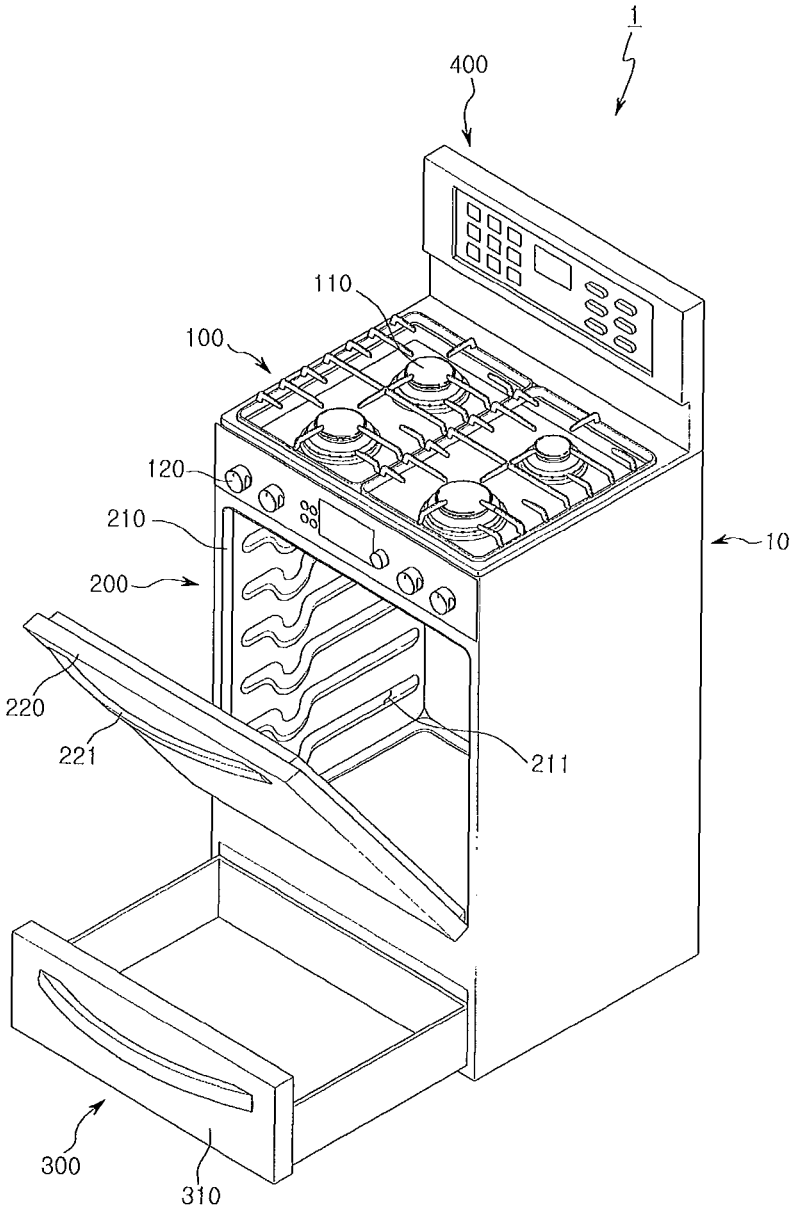
FIG. 1 is a perspective view of an oven range according to an embodiment.
Figure 2:
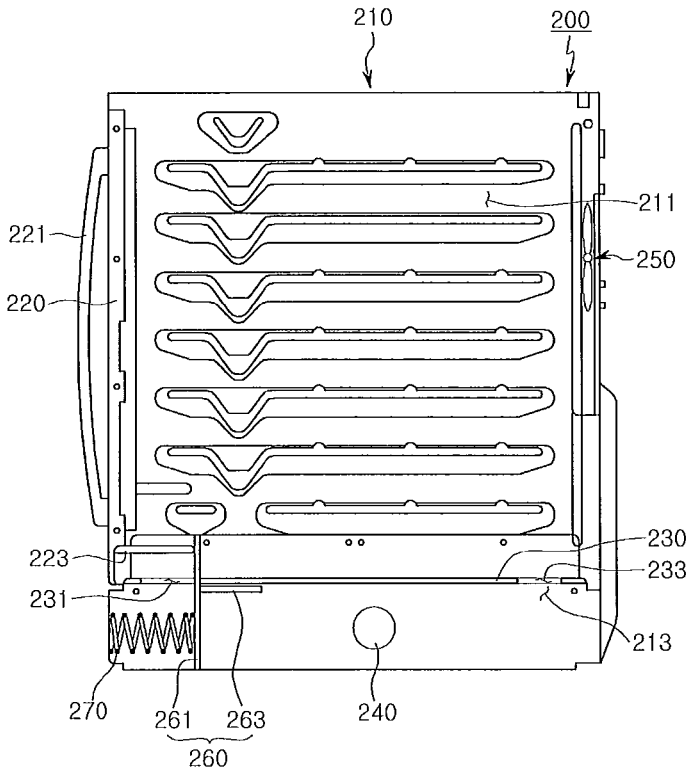
FIG. 2 is a sectional view of a closed oven chamber according to an embodiment.
Figure 3:
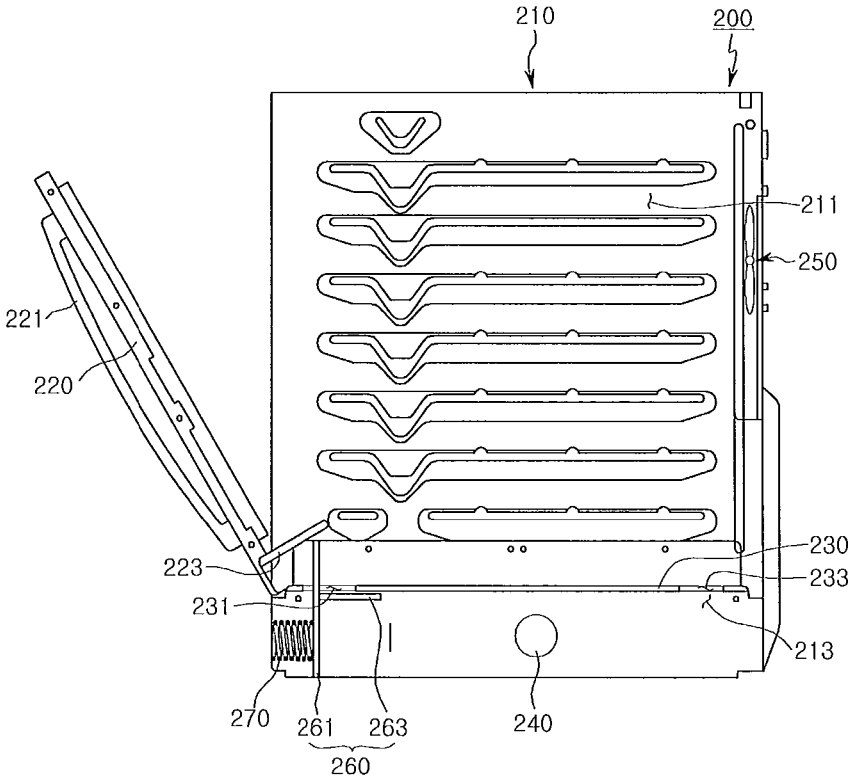
FIG. 3 is a sectional view of an opened oven chamber according to an embodiment.

FIG. 1 is a perspective view of an oven range according to an embodiment. FIG. 2 is a sectional view of a closed oven chamber according to an embodiment. FIG. 3 is a sectional view of an opened oven chamber according to an embodiment.

Referring to FIG. 1, an oven range 1 includes a cook-top part 100, an oven part 200, a drawer part 300, and a control part 400. The cook-top part 100, the oven part 200, and the drawer part 300 are disposed at upper, middle, and lower portions of a main body 10 of the oven range 1, respectively. The control part 400 is disposed on a rear end of a top surface of the main body 10 corresponding to a rear side of the cook-top part 100.

In more detail, the cook top part 100 includes a plurality of cook-top burners 110. Each of the cook-top burners 100 directly heats a container in which a food is placed using flame generated by burning gas to cook the food. A plurality of knobs 120 is disposed on a front end of the cook-top part 100. The knobs 120 open or close a valve (not shown) for supplying or blocking gas into the cook-top burner 110 and adjusting an amount of gas or adjust an opened degree of the valve.

An oven cavity 210 of the oven part 200 is defined inside the main body 10. A space is defined inside the oven cavity 210. Here, an oven chamber 211 in which the food is cooked and a burner chamber 213 (see FIGS. 2 and 3) in which a lower burner 240 is installed are defined in the space.

The oven chamber 211 is selectively opened or closed by an oven door 220. The oven door 220 opens or closes the oven chamber 211 in a pull-down manner of which a top end is rotated up and down about a lower end. A door handle 221 grasped by a user's hand is disposed on an upper end of a front surface of the oven door 220 to easily rotate the oven door 220.

Referring to FIGS. 2 and 3, driving bars 223 are disposed on both sides of a lower end of a back surface of the oven door 220. The driving bars 223 rotate the oven door 220, i.e., are linked to the opening/closing of the oven chamber 211 to translate an opening/closing member 260 (that will be described later) in front and rear directions of the oven chamber 211.

A bottom plate 230 is disposed inside the oven cavity 210. The bottom plate 230 partitions a space defined within the oven cavity 210 into the oven chamber 211 and the burner chamber 213. First and second communication openings 231 and 233 are defined in the bottom plate 230. A portion of a front end and a portion of a rear end of the bottom plate 230 are cut to define the first and second communication openings 231 and 233, respectively. The first and second communication openings 231 and 233 allow the oven chamber 211 to substantially communicate with the burner chamber 213.

The lower burner 240 is disposed inside the burner chamber 213. The lower burner 240 convectively heats the food within the oven chamber 211 using the hot air generated by burning the gas. In more detail, the lower burner 240 heats air to generate hot air for heating the food within the oven chamber 211. The hot air generated by the lower burner 240 is transmitted into the oven chamber 211 through the first and second communication openings 231 and 233. In the current embodiment, the lower burner 240 is horizontally disposed in left and right directions, and a plurality of flame holes for combustion of the gas is defined in both ends of a length direction of the lower burner 240.

The convection fan 250 is disposed on a rear surface of the oven chamber 211. The convection fan 250 calculates the hot air generated by the lower burner 240 into the oven chamber 211. In more detail, the convection fan 250 sucks the hot air in a diameter direction thereof to discharge the hot air toward a front direction of the oven chamber 211, i.e., a left side when viewed in the drawing. Thus, the hot air generated by the lower burner is circulated within the oven chamber 211.

Although not shown, an upper burner is disposed on a ceiling of the oven chamber 211. The upper burner radiatively heats the food within the oven chamber 211 using the hot air generated by burning the gas.

The opening/closing member 260 is disposed on a front end of the burner chamber 213. The opening/closing member 260 is translated in the front and rear directions of the oven chamber 211 by being linked to the rotation of the oven door 220, i.e., the opening/closing of the oven chamber 211 to selectively open or close the first communication opening 231. For this, the opening/closing member 260 includes a linkage part 261 and an opening/closing part 263.

The linkage part 261 is linked to the rotation of the oven door 220 and thus is moved in the front and rear directions of the oven chamber 211. In more detail, the linkage part 261 forms a predetermined rotation trace by the rotation of the oven door 220 for covering the oven chamber 211. Then, the linkage part 261 is moved in the rear direction of the oven chamber 211 by being pushed by the driving bar 223 or moved in the front direction of the oven chamber 211 by an elastic force of an elastic member 270 (that will be described later). In the current embodiment, the linkage part 261 has a plate shape having a predetermined length, but is not limited thereto. That is, if the linkage part 261 is positioned on a trace of the driving bar 223 by the rotation of the oven door 220, the linkage part 261 is not limited to a shape thereof.

The opening/closing part 263 extends from a side of the linkage part 261 toward the rear direction of the oven chamber 211. The opening/closing part 263 may have a size greater than that of the at least first communication opening 231. Substantially, the opening/closing part 263 selectively opens or closes the first communication opening 231. The opening/closing 263 opens the first communication opening 231 when the linkage part 261 is moved in the rear direction of the oven chamber 211 by the rotation of the oven door 220 for covering the oven chamber 211. Here, the opening/closing part 263 vertically overlaps the bottom plate 230 adjacent to the first communication opening 231. The opening/closing part 263 closes the first communication opening 231 when the linkage part 261 is moved in the front direction of the oven chamber 211 by the elastic member 270. Here, the opening/closing part 263 is disposed on the first communication opening 231.

The elastic member 270 is disposed inside the burner chamber 213. The elastic member 270 applies an elastic force to the opening/closing member 260 in a direction opposite to that in which the opening/closing member 260 is moved to open the first communication opening 231. In more detail, both ends of the elastic member 270 are supported by a front surface of the burner chamber 213 and a front surface of the linkage part 261, which face each other, respectively. Also, the elastic member 270 becomes the most tensile state in a state where the first communication opening 231 is opened. Thus, the elastic member 270 applies an elastic force for moving the linkage part 261 in the front direction of the oven chamber 211 to the opening/closing member 260, i.e., the linkage part 261.

Referring again to FIG. 1, the drawer part 300 keeps the container in which the food is placed at a predetermined temperature. The drawer part 300 includes a drawer 310 for receiving the container.

The control part 400 receives a manipulation signal for operating the oven range 1, i.e., a manipulation signal for operating at least one of the oven part 200 and the drawer part 300. Also, the control part 400 displays various information with respect to the operation of the oven range 1.

Hereinafter, an effect of the oven according to an embodiment will be described.

Referring to FIG. 2, the oven door 220 is rotated to close the oven chamber 211 in a state where the food is received within the oven chamber 211. Thus, the oven chamber 211 is closed by the oven door 220. Thus, when the oven door 220 is rotated to close the oven chamber 211, the opening/closing member 260, i.e., the linkage part 261 is pushed by the driving bar 223 and thus is moved in the rear direction of the oven chamber 211. Also, since the opening/closing part 263 is disposed overlapping the bottom plate 230, the first communication opening 231 is opened to allow the oven chamber 211 to communicate with the burner chamber 213. Here, the elastic member 270 is tensioned by the movement of the linkage part 261 due to the driving bar 223.

When the control part 400 is manipulated to select a function for cooking a food through the oven part 200, the upper burner or/and the lower burner 240 and the convection fan 250 are operated according to a kind of the food. Specifically, if the lower burner 240 is operated, the hot air generated by the heating of the lower burner 240 is transmitted into the oven chamber 211 through the first and second communication openings 231 and 233 by the operation of the convection fan 250 to heat the food.

When the food is completely cooked, the oven door 220 is rotated to open the oven chamber 211. Referring to FIG. 3, when the oven door 220 is rotated to open the oven chamber 211, the driving bar 223 is rotated while forming a predetermined trace. However, as described above, the tensile force of the elastic member 270 is applied to the linkage part 261. Thus, the linkage part 261 is moved in the front direction of the oven chamber 211 by the elastic force of the elastic member 270. Then, the opening/closing member 263 gradually closes the first communication opening 231 by the movement of the linkage part 261. When the oven door 220 completely opens the oven chamber 211, the opening/closing part 263 completely closes the first communication opening 231.

As described above, the first communication opening 231 is closed by the opening/closing member 260 in a process in which the food is taken in or out of the oven chamber 211. Also, the first communication opening 231 is opened in a process in which the food is cooked inside the oven chamber 211. Thus, since the bottom surface of the oven chamber 211 has a flat shape in a state where the oven chamber 211 is opened, an outer appearance of the product may be elegant. Also, a phenomenon in which the inside of the burner chamber 213, i.e., the lower burner 240 is contaminated through the first communication opening 231 by foreign substances such as food waste may be minimized.

According to the embodiment, there is an advantage that the food may be more uniformly cooked and also the contamination of the burner may be prevented.

According to the oven range including the above-described components, the following effects may be expected.

According to the present disclosure, the communication opening defined in the front end of the bottom surface of the oven chamber is selectively opened or closed by being linked to the rotation of the oven door for opening or closing the oven chamber, i.e., by the opening/closing member, which is moved according to the opening/closing of the oven chamber. Thus, the food may be more efficiently cooked by the hot air transmitted through the communication opening.

Also, according to the present disclosure, the first communication opening 231 is closed in the state where the oven chamber is opened, i.e., in the process in which the food is taken in or out of the oven chamber. Thus, since the phenomenon in which the burner is contaminated through the first communication opening 231 by foreign substances such as food waste may be minimized, the oven range may be more cleanly used.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oven range comprising:

a cooking chamber in which a food is cooked;

a door which selectively opens and closes the cooking chamber;

a heating chamber in which a heating source for cooking the food within the cooking chamber is disposed;

first and second communication openings formed between the cooking chamber and the heating chamber, the first and second communication openings allowing the cooking chamber to communicate with the heating chamber, the first and second communication openings spaced from each other, and the first communication opening disposed between the door and the second communication opening;

an opening/closing member that selectively opens or closes the first communication opening;

a driving bar disposed on a back side of the door, the driving bar converting a pivot movement of the door to a sliding movement of the opening/closing member; and an elastic member applying an elastic force for moving the opening/closing member in a direction in which the first communication opening is closed by the opening/closing member, wherein, when the door opens the cooking chamber, the opening/closing member closes the first communication opening without closing the second communication opening.

2. The oven range according to claim 1, wherein the first communication opening is defined by cutting a portion of a front end of a bottom surface of the cooking chamber and the second communication opening is defined by cutting a portion of a rear end of the bottom surface of the cooking chamber.

3. The oven range according to claim 1, wherein the heating source is disposed between the first and second communication openings.

4. The oven range according to claim 1, wherein the opening/closing member comprises:

a linkage part translated in front and rear directions of the cooking chamber by being pushed by the driving bar; and an opening/closing part opening or closing the first communication opening by the linkage part moved in the front and rear directions of the cooking chamber.

5. The oven range according to claim 4, wherein the elastic member is disposed between a front surface of the heating chamber and a front surface of the linkage part.

6. An oven range comprising:

an oven cavity having an oven chamber in which a food is cooked and a burner chamber in which a burner is disposed;

a bottom plate that partitions the oven chamber and the burner chamber, the bottom plate having first and second communication openings for transmitting hot air of the burner into the oven chamber;

an oven door that selectively opens or closes the oven chamber, the first communication opening being closer to the oven door and the second communication opening being closer to a rear wall of the oven cavity;

an opening/closing member that selectively opens or closes the first communication opening according to opening or closing of the oven chamber by the oven door;

a driving bar disposed on a back side of the door, the driving bar converting a pivot movement of the door to a sliding movement of the opening/closing member; and an elastic member applying an elastic force for moving the opening/closing member in a direction in which the first communication opening is closed by the opening/closing member, wherein when the door opens the cooking chamber, the opening/closing member closes the first communication opening without closing the second communication opening.

7. The oven range according to claim 6, wherein the opening/closing member is moved in a direction in which the first communication opening is opened when the oven door closes the oven chamber.

8. The oven range according to claim 6, wherein the burner is horizontally disposed under the bottom plate and has a plurality of flame holes for burning gas in both ends of a length direction thereof.

9. The oven range according to claim 6, further comprising a convection fan for circulating air heated by the burner into the oven chamber.

10. An oven range comprising:

a cooking chamber in which a food is cooked;

a door which selectively opens and closes the cooking chamber;

a heating chamber having a heating source for cooking the food within the cooking chamber;

a plurality of communication openings formed between the cooking chamber and the heating chamber, the plurality of communication openings allowing the cooking chamber to communicate with the heating chamber;

an opening/closing member that selectively opens or closes at least one of the plurality of communication openings;

a transmission device configured to transmit a moving force of the door to the opening/closing member; and an elastic member applying an elastic force for moving the opening/closing member in a direction in which the first communication opening is closed by the opening/closing member, wherein, when the door closes the cooking chamber, the opening/closing member opens a portion of the plurality of communicating openings, and wherein, when the door opens the cooking chamber, the opening/closing member closes the portion of the plurality of communicating openings without closing a remainder of the plurality of communicating openings.

* * * * *